US010747136B2

(12) United States Patent
Kenmoku et al.

(10) Patent No.: US 10,747,136 B2
(45) Date of Patent: Aug. 18, 2020

(54) TONER

(71) Applicant: CANON KABUSHIKI KAISHA, Tokyo (JP)

(72) Inventors: Takashi Kenmoku, Mishima (JP); Shota Amano, Yokohama (JP); Tomohiro Unno, Susono (JP); Hirofumi Kyuushima, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/392,085

(22) Filed: Apr. 23, 2019

(65) Prior Publication Data

US 2019/0332027 A1 Oct. 31, 2019

(30) Foreign Application Priority Data

Apr. 27, 2018 (JP) ..... 2018-086034
Mar. 28, 2019 (JP) ..... 2019-062888

(51) Int. Cl.
*G03G 9/087* (2006.01)
*G03G 9/08* (2006.01)
*G03G 9/097* (2006.01)

(52) U.S. Cl.
CPC ..... *G03G 9/09708* (2013.01); *G03G 9/0819* (2013.01); *G03G 9/0823* (2013.01); *G03G 9/08795* (2013.01)

(58) Field of Classification Search
CPC ..... G03G 9/09708; G03G 9/0821; G03G 9/0825; G03G 9/0823
See application file for complete search history.

(56) References Cited

U.S. PATENT DOCUMENTS 6,335,135 B1 * 1/2002 Arai ..... G03G 9/0819 430/108.6
6,777,153 B2 8/2004 Yano et al.
6,808,907 B2 10/2004 Honma et al.
6,908,721 B2 6/2005 Kenmoku et al.
6,911,520 B2 6/2005 Fukui et al.
7,393,912 B2 7/2008 Mihara et al.
7,399,568 B2 7/2008 Fukui et al.
7,408,017 B2 8/2008 Yano et al.
7,452,960 B2 11/2008 Yano et al.
7,510,813 B2 3/2009 Yano et al.
7,638,194 B2 12/2009 Fukui et al.
7,638,590 B2 12/2009 Fukui et al.
7,682,765 B2 3/2010 Sugawa et al.
7,935,771 B2 5/2011 Fukui et al.
8,067,136 B2 11/2011 Yano et al.
8,093,342 B2 1/2012 Minami et al.
8,110,329 B2 2/2012 Tominaga et al.
8,178,271 B2 5/2012 Fukui et al.
8,383,312 B2 2/2013 Fujimoto et al.
8,574,801 B2 11/2013 Itabashi et al.
8,609,312 B2 12/2013 Itabashi et al.
8,828,633 B2 9/2014 Itabashi et al.
9,029,056 B2 5/2015 Kenmoku et al.
9,098,002 B2 8/2015 Kenmoku et al.
9,098,003 B2 8/2015 Masumoto et al.
9,423,714 B2 8/2016 Kenmoku et al.
9,785,068 B2 10/2017 Umeda et al.
10,114,303 B2 10/2018 Katsura et al.
2005/0260514 A1 11/2005 Mihara et al.
2006/0194071 A1 8/2006 Yano et al.
2009/0142684 A1 6/2009 Anno et al.
2012/0172562 A1 7/2012 Kenmoku et al.
2013/0065174 A1 3/2013 Itabashi et al.
2017/0329246 A1 11/2017 Yamawaki et al.
2018/0246430 A1 * 8/2018 Tanaka ..... G03G 9/09716
2018/0246432 A1 * 8/2018 Nishikawa ..... G03G 9/08797
2019/0033739 A1 * 1/2019 Yamagishi ..... G03G 9/09708
2019/0033740 A1 * 1/2019 Iguchi ..... G03G 9/09716

FOREIGN PATENT DOCUMENTS

EP 3 435 166 1/2019
JP 2008-107769 A 5/2008

OTHER PUBLICATIONS

U.S. Appl. No. 16/259,104, Koki Inoue, filed Jan. 28, 2019.
"Chemical Dictionary", 1st Edition, Tokyo Kagaku Dojin (1989) 475.
"Chemical Handbook, Basic Edition II", revised 4th Edition, edited by the Chemical Society of Jpan, Maruzen (1993) 490-91.

* cited by examiner

*Primary Examiner* — Christopher D Rodee
(74) *Attorney, Agent, or Firm* — Venable LLP

(57) ABSTRACT

A toner comprising a toner particle having a binder resin and a colorant, and metal titanate fine particles, wherein the toner particle includes a polyvalent metal element having an electric resistivity of from $2.5\times10^{-8}$ Ω·m to $10.0\times10^{-8}$ Ω·m; the amount of the polyvalent metal element in the toner particle is from 0.080 μmol/g to 20.000 μmol/g; the metal titanate fine particles have a perovskite crystal structure; and the number average particle diameter of primary particles of the metal titanate fine particles is from 10 nm to 80 nm.

8 Claims, No Drawings

TONER

BACKGROUND OF THE INVENTION

Field of the Invention

The present invention relates to a toner for electrostatic image development.

Description of the Related Art

A method of visualizing image information via an electrostatic latent image, such as an electrophotographic method, is currently used in various fields, and improvement of performance including improvement of image quality and increase in speed is required.

In particular, there is a growing demand for small-sized copiers and printers with low power consumption. Therefore, there is a need for a toner which is excellent in low-temperature fixability, has good storability, and can maintain excellent image quality for a long period of time.

In response to this demand, a large number of toners produced by an emulsion aggregation method have been proposed because this method enables a wide range of material selectivity, easy control of the shape of toner particle, and the inclusion of a large amount of a release agent.

In the emulsion aggregation method, a resin particle dispersion obtained by emulsion polymerization, forced emulsification, phase inversion emulsification or the like, and a colorant dispersion in which a colorant is dispersed in a solvent are prepared. Thereafter, these are mixed to form an aggregate corresponding to a toner particle diameter, and a toner is then produced by coalescence and fusion induced by heating.

Japanese Patent Application Publication 2008-107769 discloses a toner produced by the emulsion aggregation method in which aluminum is included in a toner particle and the amount of aluminum is 0.02 to 0.30 in terms of net intensity determined by X-ray fluorescence.

It is indicated that according to this technique, a part of the aluminum amount forms a crosslinked structure with the polar part, such as carboxylic acid, in a binder resin molecule, thereby making it possible to achieve both a satisfactory charge quantity and a low-temperature fixability.

SUMMARY OF THE INVENTION

Generally, in a toner produced by the emulsion aggregation method, such as described above, polyvalent metal ions derived from a flocculant are present in the binder resin. Such polyvalent metal ions are present in the vicinity of the toner particle surface and inside the toner particle, but the presence state of the polyvalent metal ions in the toner particle tends to be non-uniform.

Meanwhile, in such a toner particle, the presence of the polyvalent metal ions derived from the flocculant in the binder resin can cause a leak of charges accumulated on the toner particle surface.

For this reason, the toner particle surface is covered with an external additive such as silica particles or titanium oxide particles, so that the charges accumulated on the toner particle surface could be appropriately leaked by the polyvalent metal ions inside the toner particle. It is thus possible to improve the charging performance.

However, when the toner deteriorates due to continuous use, embedding of external additives and the like occurs, which affects the charging performance of the toner particle surface and the inside of the toner particle.

From the above, it has been found that broadening of charge distribution of the toner causes charge-up, and image defects such as fogging and development stripes can occur, in particular, in a low-temperature and low-humidity environment.

To cope with the problem of charging performance, it is possible to improve the durability by increasing the amount of external additive added to the toner particle. However, it was found that the low-temperature fixability is lowered by the increase in the amount of external additive.

As described above, there is a trade-off relationship between low-temperature fixability and durability.

An object of the present invention is to provide a toner capable of achieving both low-temperature fixability and durability from the beginning to the end of continuous use in a toner in which a polyvalent metal element is present in a binder resin.

The present invention relates to a toner comprising a toner particle containing a binder resin and a colorant, and metal titanate fine particles, wherein the toner particle includes a polyvalent metal element having an electric resistivity of from $2.5\times10^{-8}$ Ω·m to $10.0\times10^{-8}$ Ω·m at 20° C.;

the amount of the polyvalent metal element in the toner particle is from 0.080 μmol/g to 20.000 μmol/g;

the metal titanate fine particles have a perovskite crystal structure; and the number average particle diameter of primary particles of the metal titanate fine particles is from 10 nm to 80 nm.

According to the present invention, in the toner in which the polyvalent metal element is present in the binder resin, it is possible to achieve both low-temperature fixability and durability from the beginning to the end of continuous use.

Further features of the present invention will become apparent from the following description of exemplary embodiments.

DESCRIPTION OF THE EMBODIMENTS

In the present invention, the expression "from XX to YY" or "XX to YY" representing the numerical range means a numerical range including a lower limit and an upper limit which are endpoints unless otherwise specified.

Hereinafter, the present invention will be described in detail.

The inventors of the present invention have conducted comprehensive research to achieve the following results in a toner including a toner particle in which a polyvalent metal element is present in a binder resin from the beginning to the end of continuous use:

(1) embedding of an external additive in the toner particle caused by deterioration in continuous use is suppressed;

(2) charge-up is suppressed and durability is maintained due to the charging characteristic of the toner particle even when the toner deteriorates during continuous use; and (3) in order to maintain low-temperature fixability, (1) and (2) are achieved with a small amount of external additive.

It was found out that the abovementioned results can be achieved when:

(1) a toner particle includes metal titanate fine particles having a perovskite crystal structure as an external additive, and the number average particle diameter of primary particles of the metal titanate fine particles is from 10 nm to 80 nm;

(2) the toner particle includes a polyvalent metal element having an electric resistivity of from $2.5\times10^{-8}$ Ω·m to $10.0\times10^{-8}$ Ω·m at 20° C.; and the amount of the polyvalent metal element in the toner particle is from 0.080 μmol/g to 20.000 μmol/g.

Based on the above, the inventors of the present invention have considered the reasons why the effects of the present invention are demonstrated.

In the toner produced by the emulsion aggregation method, polyvalent metal ions derived from the flocculant are present in the binder resin. Such polyvalent metal ions are present non-uniformly in the vicinity of the toner particle surface and inside the toner particle.

When externally added to such toner particle, silica fine particles, which are a high-resistance material, are influenced by the charge of polyvalent metal ions present on the toner particle surface.

At the time of external addition, the silica fine particles are easily electrostatically aggregated on the toner particle surface by the polyvalent metal ions present on the toner particle surface. As a result, the silica fine particles tend to adhere to the toner particle in a non-uniform state.

In addition, when titanium oxide fine particles, which are a medium-resistance material, are externally added, titanium oxide fine particles, whether of rutile type or anatase type, adhere to the toner particle in an aggregated state. As a result, both silica fine particles and titanium oxide particles adhere to the toner particles in a non-uniform state.

In particular, when the amount of the external additive on the toner particle in the toner is small, the external additive is likely to be present in a non-uniform state, and the charge is localized. As a result, during continuous use, the toner is likely to charge up, and image defects such as fogging and development stripes occur, in particular, in a low-temperature and low-humidity environment.

Meanwhile, it was found that when metal titanate fine particles have a perovskite crystal structure, the number average particle diameter of the primary particles thereof is from 10 nm to 80 nm, the toner particle includes a polyvalent metal element having an electric resistivity of from $2.5\times10^{-8}$ Ω·m to $10.0\times10^{-8}$ Ω·m at 20° C., and the amount of the polyvalent metal element in the toner particle is from 0.080 μmol/g to 20.000 μmol/g, the metal titanate fine particles adhere uniformly to the toner particle surface.

It was also found that when the metal titanate fine particles are externally added together with an external additive of a high-resistance material such as silica fine particles, electrostatic aggregation of the external additive of the high-resistance material is suppressed by the metal titanate fine particles, and the external additive of the high-resistance material and the metal titanate fine particles are adhered to the toner particles in a uniform state. The inventors of the present invention suppose that the effect of suppressing the electrostatic aggregation of the external additive of the high-resistance material is created as a result of the metal titanate fine particles, which are a medium-resistance material, coming in a dispersed state into contact with the external additive of the high-resistance material at the time of the external addition.

As a result, it is conceivable that even when there are few external additives on the toner particle, the charge on the toner particle surface is delocalized, so that charge-up can be suppressed.

The metal titanate fine particles have a perovskite crystal structure. The metal titanate fine particles have a cubic or rectangular parallelepiped shape. It is conceivable that this is why a spacer effect for other external additives such as silica fine particles is created and toner deterioration such as embedding of external additives is suppressed.

Further, it is necessary that the toner particle include a polyvalent metal element having an electric resistivity of from $2.5\times10^{-8}$ Ω·m to $10.0\times10^{-8}$ Ω·m at 20° C., and the amount of the polyvalent metal element in the toner particle be from 0.080 μmol/g to 20.000 μmol/g.

By setting to the above range, the toner particle can appropriately leak electric charge. As a result, the charge generated on the toner particle surface in continuous use can diffuse into the toner particle. It is conceivable that this is why the charge-up is suppressed.

As described above, as a result of the toner particle including metal titanate fine particles having a perovskite crystal structure as an external additive, the number average particle diameter of primary particles of the metal titanate fine particles being from 10 nm to 80 nm, the toner particle including a polyvalent metal element having an electric resistivity of from $2.5\times10^{-8}$ Ω·m to $10.0\times10^{-8}$ Ω·m at 20° C., and the amount of the polyvalent metal element in the toner particle being from 0.080 μmol/g to 20.000 μmol/g, it is possible to suppress the deterioration of durability, which is the problem inherent to the related art, in the toner including the toner particle in which the polyvalent metal element is present in the binder resin, even when the amount of the external additive on the toner particle is small. Therefore, the amount of external additive on the toner particle can be reduced which conceivably results in low-temperature fixability.

The metal titanate fine particles used in the present invention will be described hereinbelow. The toner preferably has metal titanate fine particles on the toner particle surface.

It is essential that the metal titanate fine particles have a perovskite crystal structure and the number average particle diameter of the primary particles be from 10 nm to 80 nm. By adopting this range, metal titanate fine particles are present in a state of uniform adhesion to the toner particle surface. This makes it possible to efficiently diffuse the charge generated on the toner particle surface, so that it is easy to suppress fogging and to suppress development stripes in a low-temperature and low-humidity environment. It is preferable that the number average particle diameter be from 10 nm to 60 nm.

Further, it is preferable that the fixing ratio of the metal titanate fine particles on the toner particle surface be from 60% to 100%. When the fixing ratio is 60.0% or more, the charge on the toner particle surface can be effectively controlled. Therefore, suppression of fogging and suppression of development stripes in a low-temperature and low-humidity environment are facilitated. The fixing ratio is more preferably from 75% to 100%, still more preferably from 88% to 100%, and particularly preferably from 88% to 99%.

The fixing ratio can be controlled by a toner manufacturing method described hereinbelow.

Further, it is preferable that the coverage ratio of the toner particle surface with the metal titanate fine particles measured by X-ray photoelectron spectroscopy (ESCA) be from 0.5% by area to 20.0% by area. When the surface coverage ratio is within this range, the proportion of metal titanate fine particles adhering in the state of primary particles increases.

As a result, the metal titanate fine particles tend to stay on the toner particle surface, and the charges generated on the toner particle surface can be effectively diffused. Further suppression of fogging and suppression of development stripes in a low-temperature and low-humidity environment are facilitated. In addition, it is easy to suppress fogging in a high-temperature and high-humidity environment. Further, when the coverage ratio is 20.0% by area or less, the amount of the external additive is appropriate, and low-temperature fixability can be satisfactorily maintained. A more preferable range is from 0.5% by area to 10.0% by area.

The coverage ratio can be controlled by the addition amount of the metal titanate fine particles or the production conditions at the time of external addition.

As the metal titanate fine particles having a perovskite crystal structure, fine particles of at least one selected from the group consisting of beryllium titanate fine particles, magnesium titanate fine particles, calcium titanate fine particles, strontium titanate fine particles, barium titanate fine particles and the like can be used.

Among them, strontium titanate fine particles capable of widely and evenly diffusing charges given to the toner particle surface on the toner particle surface are preferable. That is, the metal titanate fine particles preferably include strontium titanate, and more preferably the metal titanate particles are strontium titanate.

In the X-ray diffraction spectrum of CuKα obtained in the range of 2θ from 10° to 90°, with θ being the Bragg angle of the strontium titanate fine particles, peaks derived from the strontium titanate fine particles are at 39.700°±0.150° and 46.200°±0.150°.

Strontium titanate having peaks at these positions adopts a perovskite structure belonging to a cubic system. The peaks at 39.700°±0.150° and 46.200°±0.150° are diffraction peaks derived from the lattice planes with Miller indices (111) and (200), respectively. Generally, particles belonging to the cubic system are likely to take a hexahedral shape as the external shape of the particles.

In the production process, strontium titanate fine particles grow while maintaining (100) and (200) planes corresponding to the plane direction of the hexahedral shape.

As a result of examination by the inventors of the present invention, it was found that satisfactory characteristics are exhibited when using strontium titanate fine particles having a (200) plane corresponding to the plane direction of the hexahedral shape and a (111) plane corresponding to the apex direction.

As a result of detailed examination, it was found that when the area of the peak at 39.700°±0.150° is denoted by Sa and the area of the peak at 46.200°±0.150° is denoted by Sb, Sb/Sa is preferably from 1.80 to 2.30, and more preferably from 1.80 to 2.25. Within this range, embedding of external additives in the toner particle is further suppressed during continuous use.

It is conceivable that within the above range, the strontium titanate fine particles can adhere to the toner particle in a more uniformly dispersed state. Therefore, the charging performance between the toner particles becomes uniform. As a result, the charging performance becomes uniform from the beginning to the end of continuous use. As a result, the developing performance is improved.

It is conceivable that this results in suppression of generation of fogging and development stripes during continuous use in a low-temperature and low-humidity environment.

The number average particle diameter and Sb/Sa of the primary particles of the perovskite strontium titanate fine particles can be controlled by the molar ratio of raw materials of the strontium titanate fine particles and production conditions described below.

Perovskite-type strontium titanate fine particles can be produced by hydrothermal treatment using a pressurized container or a normal-pressure heating reaction method of reacting at normal pressure. In the present invention, a normal-pressure heating reaction method is preferable.

A mineral acid peptizing product of a hydrolysate of a titanium compound is used as a titanium oxide source, and a water-soluble acidic compound is used as a strontium source. Exemplified is a method in which a reaction is conducted while adding an alkaline aqueous solution at 60° C. or more to the mixed solutions of the sources, followed by acid treatment. The normal-pressure heating reaction method will be described below.

As a titanium oxide source, a mineral acid peptizing product of a hydrolysate of a titanium compound may be used.

Preferably, metatitanic acid obtained by a sulfuric acid method and having an $SO_3$ amount of 1.0% by mass or less, more preferably 0.5% by mass or less, is peptized while adjusting a pH to from 0.8 to 1.5 with hydrochloric acid. As a result, it is possible to obtain strontium titanate fine particles having a satisfactory particle size distribution.

Meanwhile, strontium nitrate, strontium chloride and the like can be used as the strontium source. Caustic alkali can be used as the alkaline aqueous solution, but sodium hydroxide aqueous solution is particularly preferable.

Examples of factors affecting the particle diameter of the obtained strontium titanate fine particles in the production method include the mixing ratio of the titanium oxide source and the strontium source, the concentration of the titanium oxide source at the initial stage of the reaction, the temperature and the addition speed at the time of adding the alkaline aqueous solution and the like. These factors can be appropriately adjusted in order to obtain strontium titanate fine particles having target particle diameter and particle size distribution. In order to prevent the formation of strontium carbonate during the reaction process, it is preferable to prevent carbon dioxide gas from admixing, for example, by conducting the reaction in a nitrogen gas atmosphere.

The mixing ratio of the titanium oxide source and the strontium source during the reaction is preferably from 0.90 to 1.40, and more preferably from 1.05 to 1.20 in terms of Sr/Ti (molar ratio).

The solubility of the strontium source in water is high, whereas the solubility of the titanium oxide source in water is low. Therefore, where Sr/Ti (molar ratio) is set to 0.90 or more, unreacted titanium oxide is unlikely to remain in the reaction product.

The concentration of the titanium oxide source at the initial stage of the reaction is preferably from 0.050 mol/L to 1.300 mol/L, and more preferably from 0.080 mol/L to 1.200 mol/L as $TiO_2$.

By increasing the concentration of the titanium oxide source at the initial stage of the reaction, the number average particle diameter of the primary particles of the strontium titanate fine particles can be reduced.

A product having satisfactory crystallinity can be obtained as the temperature at the time of adding the alkaline aqueous solution is higher, but a pressure vessel such as an autoclave is necessary at 100° C. or higher, and from the viewpoint of practicality, the temperature in the range of from 60° C. to 100° C. is appropriate. As for the addition rate of the alkaline aqueous solution, the strontium titanate fine particles having a larger particle diameter are obtained as the addition rate is lower, and strontium titanate fine particles having a smaller particle diameter can be obtained as the addition rate is higher. The addition rate of the alkaline aqueous solution with respect to the material charged is preferably from 0.001 equivalent/h to 1.2 equivalent/h, and more preferably from 0.002 equivalent/h to 1.1 equivalent/h. The temperature and addition rate can be appropriately adjusted according to the particle diameter to be obtained.

Next, acid treatment will be described. Where the mixing ratio of the titanium oxide source and the strontium source is 1.40 or less in terms of Sr/Ti (molar ratio), it is possible to suppress the generation of impurities such as strontium carbonate by reaction of the unreacted strontium source, which remains after completion of the reaction, with carbon dioxide gas in the air, and a sharp particle size distribution can be obtained.

Further, where impurities such as strontium carbonate remain on the surface, the impurities make it difficult to coat the surface treatment agent uniformly when surface treatment is performed to impart hydrophobicity. Therefore, after the alkaline aqueous solution is added, acid treatment may be performed in order to remove the unreacted strontium source. In the acid treatment, it is preferable to adjust the pH to from 2.5 to 7.0 using hydrochloric acid, more preferably to adjust the pH to from 4.5 to 6.0.

As the acid, besides hydrochloric acid, nitric acid, acetic acid, and the like can be used for acid treatment.

Next, a control method of Sb/Sa will be described. Dry mechanical treatment can be also exemplified as a method for obtaining the strontium titanate fine particles.

For example, HYBRIDIZER (manufactured by Nara Machinery Co., Ltd.), NOBILTA (manufactured by Hosokawa Micron Corporation), MECHANO FUSION (manufactured by Hosokawa Micron Corporation), HIGH FLEX GRAL (manufactured by EARTHTECHNICA Co., Ltd.), and the like can be used. Sb/Sa can be easily controlled to from 1.80 to 2.30 by treating strontium titanate fine particles with these devices.

When the shape of the strontium titanate fine particles is controlled by mechanical treatment, fine powder of strontium titanate fine particles may be generated. In order to remove the fine powder, it is preferable to perform acid treatment after the mechanical treatment. In the acid treatment, it is preferable to adjust the pH to from 0.1 to 5.0 with hydrochloric acid. As the acid, besides hydrochloric acid, nitric acid, acetic acid, and the like can be used for acid treatment. The mechanical treatment for controlling the shape of the strontium titanate fine particles is preferably carried out before the surface treatment of the strontium titanate fine particles.

The metal titanate fine particles may be surface-coated with a treatment agent in order to adjust charging and improve environmental stability.

Examples of the treating agent are presented hereinbelow.

Titanium coupling agents;

silane coupling agents;

silicone oils;

fatty acid metal salts such as zinc stearate, sodium stearate, calcium stearate, zinc laurate, aluminum stearate, magnesium stearate and the like; and fatty acids such as stearic acid and the like.

The treatment method can be exemplified by a wet method in which a surface treatment agent or the like is dissolved/dispersed in a solvent, metal titanate fine particles are added thereto, and the solvent is removed under stirring, and a dry method in which a coupling agent, a fatty acid metal salt and metal titanate fine particles are directly mixed and treated under stirring.

The amount of the metal titanate fine particles is preferably from 0.02 parts by mass to 2.00 parts by mass, and more preferably from 0.05 parts by mass to 2.00 parts by mass with respect to 100 parts by mass of the toner particles.

The toner particle will be described hereinbelow.

The toner particle includes a polyvalent metal element having an electric resistivity of from $2.5\times10^{-8}$ Ω·m to $10.0\times10^{-8}$ Ω·m at 20° C. Further, the amount of the polyvalent metal element in the toner particles is from 0.080 μmol/g to 20.000 μmol/g. This amount is preferably from 0.08 μmol/g to 14.000 μmol/g.

The inventors of the present invention considered that a component that can appropriately leak charge can be included in a toner particle in order to suppress the charge-up and to maintain durability by a charging characteristic of the toner particle even when the toner deteriorates due to continuous use. It is conceivable to include a substance having a specific electric resistivity in the toner to enable appropriate leak. The inventors of the present invention have found that, among the substances having a specific electric resistivity, a particular effect in suppressing the charge-up is demonstrated when the abovementioned ranges are satisfied.

Values described in, for example, "Chemical Dictionary" (1st Edition, Tokyo Kagaku Dojin, 1989), "Chemical Handbook, Basic Edition II" (revised 4th edition, edited by The Chemical Society of Japan, Maruzen, 1993, 490 pages) may be used for the electric resistivity of various substances at 20° C.

In the present invention, it is necessary to use a polyvalent metal element having an electric resistivity of from $2.5\times10^{-8}$ Ω·m to $10.0\times10^{-8}$ Ω·m at 20° C.

For example, at least one metal selected from the group consisting of aluminum ($2.7\times10^{-8}$ Ω·m), calcium ($3.5\times10^{-8}$ Ω·m), magnesium ($4.5\times10^{-8}$ Ω·m), cobalt ($6.2\times10^{-8}$ Ω·m), zinc ($5.9\times10^{-8}$ Ω·m), nickel ($6.9\times10^{-8}$ Ω·m), and iron ($9.7\times10^{-8}$ Ω·m) can be used.

When the electric resistivity at 20° C. is smaller than $2.5\times10^{-8}$ Ω·m, charge leakage easily occurs under a high-temperature and high-humidity environment. Meanwhile, when the electric resistivity exceeds $10.0\times10^{-8}$ Ω·m, the effect of suppressing the charge-up cannot be said to be sufficient.

Further, where the amount of the polyvalent metal element in the toner particle is 0.080 μmol/g or more, the effect of suppressing the charge-up can be satisfactorily obtained.

Meanwhile, where the amount is too large, the fixing performance is lowered and fogging due to charge leak can occur under a high-temperature and high-humidity environment. Therefore, the amount of the polyvalent metal element in the toner particle needs to be 20.000 μmol/g or less. In the case where two or more polyvalent metal elements with the aforementioned electric resistivity range are included, the above amount range is the sum of the amounts of the polyvalent metal elements.

There is no particular limitation on the means for including the polyvalent metal element into the toner particle. For example, when the toner particle is produced by a pulverization method, the polyvalent metal element may be included in the raw material resin in advance, or the polyvalent metal element may be added to the toner particle when the raw materials are melt-kneaded.

When the toner particle is produced by a wet production method such as a polymerization method, the polyvalent metal element can be included in raw materials or can be added via an aqueous medium in the production process. In the wet production method, it is preferable from the viewpoint of homogenization to include the polyvalent metal element in the toner particle via the state of ionization in an aqueous medium.

This procedure is particularly preferable when the polyvalent metal element is at least one selected from the group consisting of aluminum, iron, magnesium, and calcium, because the ionization tendency is comparatively strong and ionization is facilitated.

There is no particular limitation on the form of the polyvalent metal element when mixing at the time of production, but it is possible to use an element itself or a halide, a hydroxide, an oxide, a sulfide, a carbonate, a sulfate, a hexafluorosilylate, an acetate, a thiosulfate, a phosphate, a chlorate, a nitrate, and the like thereof. As described above, it is preferable to incorporate these in the toner particle via a state of ionization once in an aqueous medium.

The aqueous medium refers to a medium including 50% by mass or more of water and 50% by mass or less of a water-soluble organic solvent. The water-soluble organic solvent can be exemplified by methanol, ethanol, isopropanol, butanol, acetone, methyl ethyl ketone, and tetrahydrofuran.

When the aqueous medium includes hydroxyapatite and the polyvalent metal element is calcium, attention needs to be paid to the addition amount of calcium. The chemical formula of hydroxyapatite is $Ca_{10}(PO_4)_6(OH)_2$, and the ratio of the number of moles of calcium to phosphorus is 1.67. Therefore, under the condition of $M(Ca) \leq 1.67\ M(P)$, where M(Ca) is the number of moles of calcium and M(P) is the number of moles of phosphorus, calcium is easily taken into the hydroxyapatite crystal. Therefore, it is preferable that calcium be present in an amount exceeding this amount.

Binder Resin

The toner particle includes a binder resin. The binder resin is not particularly limited, and conventionally known binder resins can be used. A combination in which the binder resin includes a carboxyl group and the polyvalent metal element is at least one selected from the group consisting of aluminum, iron, magnesium, and calcium is particularly preferable.

In the case where the polyvalent metal element includes aluminum (preferably, the polyvalent metal element is aluminum), the amount of aluminum in the toner particle is preferably from 0.080 μmol/g to 0.400 μmol/g, and more preferably from 0.100 μmol/g to 0.320 μmol/g.

In the case where the polyvalent metal element includes iron (preferably, the polyvalent metal element is iron), the amount of iron in the toner particle is preferably from 0.250 μmol/g to 1.250 μmol/g, more preferably from 0.375 μmol/g to 1.000 μmol/g.

When the polyvalent metal element includes magnesium (preferably, the polyvalent metal element is magnesium), the amount of magnesium in the toner particle is preferably from 2.000 μmol/g to 20.000 μmol/g, and more preferably from 4.000 μmol/g to 14.000 μmol/g.

When the polyvalent metal element includes calcium (preferably, the polyvalent metal element is calcium), the amount of calcium in the toner particle is preferably from 2.000 μmol/g to 20.000 μmol/g, and more preferably from 4.000 μmol/g to 14.000 μmol/g.

The amount of these polyvalent metal elements can be controlled by the addition amount of the polyvalent metal element-containing substance at the time of preparing the toner particle.

The effect of the binder resin having a carboxyl group is that degradation due to continuous use is suppressed and embedding of external additive is further suppressed. This is presumably because the presence of carboxyl groups and the polyvalent metal in the binder resin causes partial metal crosslinking and produces an effect of suppressing deterioration even when a strong shear is applied to the toner.

It is conceivable that the reason why the preferable amount range of the polyvalent metal element differs depending on the substance is related to the valence of the metal. Thus, it is conceivable that when the valence is high, coordination with a carboxyl group can be achieved with a small amount of metal, so that the preferable amount of trivalent aluminum is small, the preferable amount of divalent magnesium and calcium is large, and the preferable amount of iron which can take mixed valence is therebetween.

The acid value of the binder resin is preferably from 1.0 mg KOH/g to 40.0 mg KOH/g.

Within this range of acid value, it is possible to achieve both the effect of suppressing toner deterioration and the effect of suppressing inhibition against fixability.

The binder resin is preferably a vinyl resin, a polyester resin or the like. The vinyl resin, polyester resin and other binder resins can be exemplified by the following resins or polymers.

Homopolymers of styrene such as polystyrene and polyvinyl toluene and substituents thereof; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosin, terpene resins, phenolic resins, aliphatic or alicyclic hydrocarbon resins, and aromatic petroleum resin.

These binder resins can be used singly or in combination. Styrene copolymers are preferable.

The binder resin preferably includes a carboxyl group, and a resin produced using a polymerizable monomer including a carboxyl group is preferable.

Examples of the polymerizable monomer including a carboxyl group include acrylic acid and methacrylic acid; α-alkyl derivatives or β-alkyl derivatives of acrylic acid or methacrylic acid such as α-ethyl acrylic acid, crotonic acid and the like; unsaturated dicarboxylic acids such fumaric acid, maleic acid, citraconic acid, itaconic acid and the like; unsaturated dicarboxylic acid monoester derivatives such as succinic acid monoacryloyloxyethyl ester, succinic acid monoacryloyloxyethylene ester, phthalic acid monoacryloyloxyethyl ester, phthalic acid monomethacryloyloxyethyl ester and the like; and the like.

As the polyester resin, one obtained by polycondensation of the following carboxylic acid component and alcohol component can be used.

Examples of the carboxylic acid component include terephthalic acid, isophthalic acid, phthalic acid, fumaric acid, maleic acid, cyclohexanedicarboxylic acid, and trimellitic acid.

Examples of the alcohol component include bisphenol A, hydrogenated bisphenol, ethylene oxide adduct of bisphenol A, propylene oxide adduct of bisphenol A, glycerin, trimethylolpropane, and pentaerythritol.

Further, the polyester resin may be a polyester resin including a urea group. A polyester resin in which a carboxyl group such as a terminal is not capped is preferable.

Crosslinking Agent

In order to control the molecular weight of the binder resin constituting the toner particle, a crosslinking agent may be added during polymerization of the polymerizable monomer.

Examples of the crosslinking agent include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester type diacrylate, (MANDA, Nippon Kayaku Co., Ltd.), and the abovementioned compounds is which acrylate is changed to methacrylate.

The addition amount of the crosslinking agent is preferably from 0.001 parts by mass to 15.000 parts by mass with respect to 100 parts by mass of the polymerizable monomer.

Release Agent

The toner particle may include a release agent.

Examples of the release agent include petroleum waxes and derivatives thereof such as paraffin wax, microcrystalline wax and petrolatum, montan wax and derivatives thereof, hydrocarbon wax obtained by the Fischer-Tropsch process and derivatives thereof, polyolefin waxes such as polyethylene and polypropylene and derivatives thereof, natural waxes such as carnauba wax and candelilla wax and derivatives thereof, higher aliphatic alcohols, fatty acids such as stearic acid and palmitic acid, and acid amide, ester and ketone thereof, hydrogenated castor oil and derivatives thereof, vegetable waxes, animal waxes and silicone resins.

Incidentally, derivatives include oxides, block copolymers with vinyl monomers, and graft modified products. The amount of the release agent is preferably from 5.0 parts by mass to 20.0 parts by mass with respect to 100.0 parts by mass of the binder resin or the polymerizable monomer that produces the binder resin.

Colorant

The colorant is not particularly limited, and known colorants can be used.

Examples of yellow pigments include yellow iron oxide and condensed azo compounds such as Navels Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, and the like, isoindolinone compounds, anthraquinone compounds, azo metal complexes, methine compounds, and allylamide compounds. Specific examples are presented hereinbelow.

C. I. Pigment Yellow 12, 13, 14, 15, 17, 62, 74, 83, 93, 94, 95, 109, 110, 111, 128, 129, 147, 155, 168, 180, 185, 193.

Examples of orange pigments are presented below.

Permanent Orange GTR, Pyrazolone Orange, Vulcan Orange, Benzidine Orange G, Indanthrene Brilliant Orange RK, and Indathrene Brilliant Orange GK.

Examples of red pigments include Indian Red, condensation azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, Alizarin Lake and the like, diketopyrrolopyrrole compounds, anthraquinone compounds, quinacridone compounds, basic dye lake compounds, naphthol compounds, benzimidazolone compounds, thioindigo compounds, perylene compounds. Specific examples are presented hereinbelow.

C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 254.

Examples of blue pigments include copper phthalocyanine compounds and derivatives thereof such as Alkali Blue Lake, Victoria Blue Lake, Phthalocyanine Blue, metal-free Phthalocyanine Blue, partial Phthalocyanine Blue chloride, Fast Sky Blue, Indathrene Blue BG and the like, anthraquinone compounds, basic dye lake compound and the like. Specific examples are presented hereinbelow.

C. I. Pigment Blue 1, 7, 15, 15:1, 15:2, 15:3, 15:4, 60, 62, 66.

Examples of purple pigments include Fast Violet B and Methyl Violet Lake.

Examples of green pigments include Pigment Green B, Malachite Green Lake, and Final Yellow Green G. Examples of white pigments include zinc white, titanium oxide, antimony white and zinc sulfide.

Examples of black pigments include carbon black, aniline black, non-magnetic ferrites, magnetite, and those which are colored black by using the abovementioned yellow colorant, red colorant and blue colorant. These colorants can be used singly or in a mixture, or in the form of a solid solution.

If necessary, the colorant may be surface-treated with a substance which does not inhibit polymerization.

The amount of the colorant is preferably from 3.0 parts by mass to 15.0 parts by mass with respect to 100.0 parts by mass of the binder resin or the polymerizable monomer that produces the binder resin.

Charge Control Agent

The toner particle may include a charge control agent. As the charge control agent, known charge control agents can be used. In particular, a charge control agent that has a high charging speed and can stably maintain a constant charge amount is preferable. Further, in the case where the toner particle is produced by a direct polymerization method, a charge control agent that has a low polymerization inhibition property and is substantially not solubilized in an aqueous medium is preferable.

Examples of charge control agents that control the toner particles to be negatively chargeable are presented hereinbelow.

Organometallic compounds and chelate compounds exemplified by monoazo metal compounds, acetylacetone metal compounds, and metal compounds based on aromatic hydroxycarboxylic acids, aromatic dicarboxylic acids, hydroxycarboxylic acids and dicarboxylic acids. Other examples include aromatic hydroxycarboxylic acids, aromatic mono- and polycarboxylic acids and metal salts, anhydrides, esters, phenol derivatives, such as bisphenol, thereof and the like. Furthermore, urea derivatives, metal-containing salicylic acid compounds, metal-containing naphthoic acid compounds, boron compounds, quaternary ammonium salts, and calixarenes can be mentioned.

These charge control agents can be contained singly or in combination of two or more thereof. The addition amount of the charge control agent is preferably from 0.01 parts by mass to 10.00 parts by mass with respect to 100.00 parts by mass of the binder resin.

External Additive

The toner particle may be used as it is as a toner, but in order to improve flowability, charging performance, cleaning property, and the like, a fluidizing agent, a cleaning aid or the like, which is the so-called external additive, may be added to obtain the toner.

Examples of the external additive include inorganic fine particles such as silica fine particles, alumina fine particles, titanium oxide fine particles and the like.

These can be used singly or in combination of two or more thereof. These inorganic fine particles are preferably subjected to a gloss treatment with a silane coupling agent, a titanium coupling agent, a higher fatty acid, a silicone oil or the like in order to improve heat-resistant storability and environmental stability. The BET specific surface area of the external additive is preferably from 10 $m^2/g$ to 450 $m^2/g$.

The BET specific surface area can be determined by a low-temperature gas adsorption method based on a dynamic constant pressure method according to a BET method (preferably a BET multipoint method). For example, the BET specific surface area ($m^2/g$) can be calculated by adsorbing nitrogen gas on the surface of a sample and performing measurement by the BET multipoint method by using a specific surface area measuring apparatus (trade name: GEMINI 2375 Ver. 5.0, manufactured by Shimadzu Corporation).

The total amount of these various external additives is preferably from 0.05 parts by mass to 5.00 parts by mass with respect to 100 parts by mass of the toner particles. The type and amount of the external additive can be appropriately selected as long as the effect of the present invention is not impaired. Various external additives may be used in combination.

Developer

The toner can be used as a one-component developer, but it may be also mixed with a carrier and used as a two-component developer.

As the carrier, magnetic particles composed of conventionally known materials such as metals such as iron, ferrites, magnetite and alloys of these metals with metals such as aluminum and lead can be used. Among them, ferrite particles are preferable. Further, a coated carrier obtained by coating the surface of magnetic particles with a coating agent such as a resin, a resin dispersion type carrier obtained by dispersing magnetic fine powder in a binder resin, or the like may be used as the carrier.

The volume average particle diameter of the carrier is preferably from 15 μm to 100 μm, and more preferably from 25 μm to 80 μm.

Method for Producing Toner Particles

Known methods can be used for producing the toner particles. Thus, a kneading pulverization method or a wet production method can be used. From the viewpoint of uniform particle diameter and shape controllability, the wet production method is preferable. The wet production methods include a suspension polymerization method, a dissolution suspension method, an emulsion polymerization aggregation method, an emulsion aggregation method, and the like, and an emulsion aggregation method is more preferable. That is, it is preferable that the toner particle be an emulsion aggregation toner particle. This is because it is easy to ionize the polyvalent metal element in the aqueous medium, and polyvalent metal elements are easily included in the toner particle when aggregating the binder resin.

In the emulsion aggregation method, first, dispersions of materials such as fine particles of a binder resin and a colorant are prepared. The obtained dispersions of each material are dispersed and mixed by adding a dispersion stabilizer as necessary. Then, a flocculant is added to cause aggregation until the desired particle diameter of the toner particle is reached, and thereafter or simultaneously with the aggregation, the resin fine particles are fused together. Further, if necessary, toner particles are formed by controlling shape by heat.

Here, the fine particles of the binder resin can be composite particles formed of a plurality of layers composed of two or more layers of resins having different compositions. For example, such fine particles can be produced by an emulsion polymerization method, a mini-emulsion polymerization method, a phase inversion emulsification method or the like, or by a combination of several production methods.

In the case where an internal additive is contained in the toner particles, the internal additive may be included in the resin fine particles, or a dispersion of the internal additive fine particles comprising only the internal additive may be separately prepared, and the internal additive fine particles may be aggregated together with the fine resin particles at the time of aggregation. In addition, by aggregating resin fine particles having different compositions by adding with a difference in time at the time of aggregation, it is also possible to prepare toner particles having layer configurations of different compositions.

The following dispersion stabilizer can be used.

Known cationic surfactants, anionic surfactants, and nonionic surfactants can be used as the surfactant.

The inorganic dispersion stabilizer can be exemplified by tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The organic dispersion stabilizer can be exemplified by polyvinyl alcohol, gelatin, methylcellulose, methylhydroxypropylcellulose, ethylcellulose, sodium salt of carboxymethylcellulose, and starch.

From the viewpoint of high definition and high resolution of the image, it is preferable that the weight average particle diameter of the toner particles be from 3.0 to 10.0 μm.

Method for Producing Toner

For example, a double cone mixer, a V-type mixer, a drum mixer, a super mixer, an FM mixer (manufactured by Nippon Coke & Engineering Co., Ltd.), a Nauta mixer, a MechanoHybrid mixer, and the like can be used as an external addition apparatus in the production of toner.

From the viewpoint of controlling the titanium metal fine particles to a desired state, an FM mixer (manufactured by Nippon Coke & Engineering Co., Ltd.) is preferable. In order to control the state of the metal titanate fine particles, the toner can be prepared by adjusting the rotation speed, treatment time, water temperature and water amount of the jacket. This makes it possible to control the fixing ratio of the metal titanate fine particles on the toner particle surface.

Measurement methods of various physical properties of toner, toner particles, metal titanate fine particles, and other materials will be described below.

Physical properties of the metal titanate fine particles are measured using a toner as a sample. Alternatively, in the case of measuring the physical properties of metal titanate fine particles or toner particles from a toner externally added with metal titanate fine particles, the properties can be measured by separating metal titanate fine particles and other external additives from the toner.

In that case, the toner is ultrasonically dispersed in methanol to separate metal titanate fine particles and other external additives, and allowed to stand for 24 h. Toner particles can be isolated by separating and recovering the sedimented toner particles and the metal titanate fine particles and other external additives dispersed in the supernatant, and then sufficiently drying. The metal titanate fine particles can also be isolated by treating the supernatant liquid by centrifugation.

Measurement of Particle Diameter of Toner Particles

The particle diameter of the toner particles can be measured by a fine pore electric resistance method. For example, the measurement and calculation can be performed using "Coulter Counter Multisizer 3" and the dedicated software "Beckman Coulter Multisizer 3 Version 3.51" (manufactured by Beckman Coulter, Inc.).

A precision particle size distribution measuring apparatus (registered trademark, "Coulter Counter Multisizer 3", manufactured by Beckman Coulter, Inc.) based on a pore electric resistance method and the dedicated software "Beckman Coulter Multisizer 3 Version 3.51" (manufactured by Beckman Coulter, Inc.) are used. The measurement is performed using an aperture diameter of 100 μm with 25,000 effective measurement channels, and the measurement data are analyzed and calculated.

A solution prepared by dissolving special grade sodium chloride in ion exchanged water to a concentration of about 1% by mass, for example, "ISOTON II" (trade name) manufactured by Beckman Coulter, Inc., can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM) SCREEN" of the dedicated software, the number of measurements is set to 1, and a value obtained using "standard particles 10.0 μm" (manufactured by Beckman Coulter, Inc.) is set as a Kd value. The threshold and the noise level are automatically set by pressing the measurement button of the threshold/noise level. Further, the current is set to 1600 μA, the gain is set to 2, the electrolytic solution is set to ISOTON II (trade name), and "FLUSH OF APERTURE TUBE AFTER MEASUREMENT" is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE" function of the dedicated software.

(2) Approximately 30 mL of the electrolytic aqueous solution is placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments, manufactured by Wako Pure Chemical Industries, Ltd.) with ion exchanged water is added.

(3) A predetermined amount of ion exchanged water is placed in the water tank of an ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees, and about 2 mL of CONTAMINON N (trade name) is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner (particles) is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner (particles) is dispersed is dropped using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the apparatus, and the weight average particle diameter (D4) is calculated. The "AVERAGE DIAMETER" on the "ANALYSIS/VOLUME STATISTICAL VALUE (ARITHMETIC MEAN)" screen when the special software is set to graph/volume % is the weight average particle diameter (D4). The "AVERAGE DIAMETER" on the "ANALYSIS/NUMBER STATISTICAL VALUE (ARITHMETIC MEAN)" screen when the special software is set to graph/number % is the number average particle diameter (D1).

Number Average Particle Diameter of Primary Particles of Metal Titanate Fine Particles The number average particle diameter of the primary particles of the metal titanate fine particles is measured with a transmission electron microscope "JEM-2800" (JEOL Ltd.). The toner externally added with the metal titanate fine particles is observed, and the major diameter of the primary particles of 100 metal titanate fine particles is randomly measured in a field enlarged up to 200,000 times to determine the number average particle diameter. The observation magnification is appropriately adjusted according to the size of the metal titanate fine particles.

As a method of discriminating the metal titanate fine particles from the external additive of the toner, elemental analysis of the toner particle surface using the below-described X-ray photoelectron spectroscopy apparatus can be performed. Alternatively, as described above, it is also possible to discriminate the isolated metal titanate fine particles by similar elemental analysis.

Whether or not the metal titanate fine particles have a perovskite crystal structure can be determined by analyzing the metal titanate fine particles isolated as described above with a powder X-ray diffractometer.

Presence or Absence of Metal Titanate Fine Particles on Toner Particle Surface and Measurement of Coverage Ratio The presence or absence of the metal titanate fine particles on the toner particle surface can be confirmed and the measurement of coverage ratio can be performed by elemental analysis of the toner particle surface.

The measurement apparatus and measurement conditions are described hereinbelow.

Measurement apparatus: X-ray photoelectron spectrometer: Quantum 2000 (trade name, manufactured by ULVAC-PHI Corporation)

X-ray source: monochrome Al Kα

X-ray Setting: 100 μm φ (25 W (15 KV))

Photoelectron pick up angle: 45 degrees

Neutralization condition: combined neutralization gun and ion gun

Analysis area: 300×200 μm

Pass Energy: 58.70 eV

Step size: 0.125 eV

Analysis software: Maltipak (PHI Co.)

Here, the peak of Ti 2p (B. E. 452 eV to 468 eV) was used for calculating the quantitative value of a Ti atom. The quantitative value of the Ti element obtained here is denoted by Z1. Next, elemental analysis of the single metal titanate fine particle is performed similarly to the elemental analysis on the surface of the toner particle described hereinabove, and the quantitative value of the Ti element obtained here is denoted by Z2. The coverage ratio of the toner particle surface with the metal titanate fine particles is defined by the following formula using Z1 and Z2.

$$\text{Coverage ratio (\% by area)} = Z1/Z2 \times 100$$

Method for Measuring Fixing Ratio of Metal Titanate Fine Particles to Toner Particle First, two kinds of samples (toner before water washing and toner after water washing) are prepared.

(i) Toner before water washing: various toners prepared in Examples described hereinbelow are used as they are.

(ii) Toner after water washing: 160 g of sucrose (manufactured by Kishida Chemical Co., Ltd.) is added to 100 mL of ion exchanged water, and dissolved while heating with hot water to prepare a sucrose concentrated solution. A total of 31 g of the sucrose concentrated solution and 6 mL of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) are placed in a centrifuge tube to prepare a dispersion.

A total of 1 g of toner is added to the dispersion and the toner lump is loosened with a spatula or the like. The centrifuge tube is then shaken with a shaker at 5.8 $s^{-1}$ for 20 min. After shaking, the solution is transferred to a glass tube (50 mL) for a swing rotor and centrifuged with a centrifuge at 58.3 $s^{-1}$ for 30 min. Sufficient separation of the toner and aqueous solution is visually confirmed, and the toner separated to the uppermost layer is collected with a spatula or the like. The aqueous solution including the collected toner is filtered with a vacuum filter and dried in a dryer for 1 h or more to obtain a sample.

Quantitative determination of metal titanate fine particles is performed and the fixing ratio is obtained by using the intensity of the target element (for example, Sr in the case of using strontium titanate fine particles as metal titanate fine particles) in wavelength dispersive X-ray fluorescence analysis (XRF) of these samples before and after washing with water.

A tablet as a measurement sample is prepared by placing approximately 1 g of each of the toner after washing with water and the toner before washing with water in a dedicated pressing aluminum ring, flattening, pressing at 20 MPa for 60 sec, with a tablet compacting machine "BRE-32" (Maekawa Testing Machine MFG. Co., Ltd.), and molding to a thickness of about 2 mm.

As the measurement apparatus, a wavelength dispersive fluorescent X-ray analyzer "Axios" (manufactured by PANalytical Co., Ltd.) and dedicated software "SuperQ ver. 4.0 F" (manufactured by PANalytical Co., Ltd.) are used for setting the measurement conditions and analyzing the measurement data. Rh is used as the anode of an X-ray tube, the measurement atmosphere is vacuum, the measurement diameter (collimator mask diameter) is 10 mm, and the measurement time is 10 sec. Further, a proportional counter (PC) is used for detection when measuring light elements, and a scintillation counter (SC) is used for detection when measuring heavy elements. The measurement is carried out under the above conditions, elements are identified on the basis of the obtained X-ray peak position, and the concentration thereof is calculated from the count rate (unit: cps) which is the number of X-ray photons per unit time.

As for the fixing ratio of metal titanate fine particles to the toner particles, firstly, the intensity of the element of the toner before washing with water and the toner after washing with water is determined by the above method. Thereafter, the fixing ratio is calculated based on the following formula. As an example, the formula is shown that relates to the case where strontium titanate fine particles are used as metal titanate fine particles and Sr is used as a target element.

$$\text{Fixing ratio of strontium titanate} = (\text{intensity of Sr element of toner after washing with water})/(\text{intensity of Sr element of toner before washing with water}) \times 100$$

Diffraction Peaks of Strontium Titanate Fine Particles

A powder X-ray diffractometer "SmartLab" (manufactured by Rigaku Corporation, high-resolution X-ray diffractometer with horizontal sample mount) is used for measuring the positions of diffraction peaks of the strontium titanate fine particles. Analysis software "PDXL 2 (version 2.2.2.0)" provided with the diffractometer is used for calculation of Sb/Sa from the obtained peak.

Sample Preparation

The measurement was carried out after uniformly loading a measurement sample in a Boro-Silicate capillary (manufactured by W. Muller) having a diameter of 0.5 mm.

Measurement Conditions

Tube: Cu

Optical system: CBO-E

Sample base: capillary sample base

Detector: D/tex Ultra 250 detector

Voltage: 45 kV

Current: 200 mA

Start angle: 10°

End angle: 60°

Sampling width: 0.02°

Speed measurement time setting value: 10

IS: 1 mm

RS1: 20 mm

RS2: 20 mm

Attenuator: Open

Capillary rotation speed setting value: 100

For other conditions, the initial setting values of the apparatus are used.

Analysis

First, the obtained peaks are subjected to peak separation processing using software "PDXL 2" provided with the apparatus. Peak separation is obtained by executing optimization by using "Split-Type Voigt Function" selectable with the PDXL, and the obtained integrated intensity value is used. The 2θ value of the diffraction peak top and the area thereof are thereby determined. Sb/Sa is calculated from the peak area of the predetermined 2θ value. Here, in the case of a large deviation between the calculation result of peak separation and the actually measured spectrum, processing such as manual setting of the baseline is performed, and adjustment is made so that the calculation result matches the actually measured spectrum.

Although strontium titanate fine particles are hereinabove exemplified as metal titanate fine particles, the same processing can be performed with respect to particles other than the strontium titanate fine particles.

Molar Ratio of Sr/Ti of Strontium Titanate Fine Particles

The amount of Sr and Ti in the strontium titanate fine particles can be measured with a fluorescent X-ray analyzer. For example, a wavelength-dispersive fluorescent X-ray analyzer Axios advanced (manufactured by PANalytical Co.) is used, 1 g of a sample is weighed in a cup (dedicated to powder measurement recommended by PANalytical Co.) to which a dedicated film has been attached, and elements from Na to U in the strontium titanate fine particles are measured by an FP method under a He atmosphere and atmospheric pressure.

In this case, it is assumed that all the detected elements are oxides, the total mass thereof is taken as 100%, the amount (% by mass) of SrO and $TiO_2$ relative to the total mass is determined by software SpectraEvaluation (version 5.0 L) as an oxide conversion value, and the molar ratio of Sr/Ti is then determined by converting oxygen into the amount of Sr and Ti.

Hydrophobicity of Strontium Titanate Fine Particles

The hydrophobicity of strontium titanate fine particles is measured by a powder wettability tester "WET-100P" (manufactured by RHESCA Co., Ltd.).

A spindle type rotor coated with a fluororesin and having a length of 25 mm and a maximum barrel diameter of 8 mm is placed in a cylindrical glass container having a diameter of 5 cm and a thickness of 1.75 mm. A total of 70 mL of water-containing methanol including of 50% by volume of methanol and 50% by volume of water is poured in the cylindrical glass container, then 0.5 g of the strontium titanate fine particles is added, and the container is set in the powder wettability tester.

Methanol is added to the liquid at a rate of 0.8 mL/min through the powder wettability tester while stirring at a rate of 200 rpm using a magnetic stirrer. The transmittance is measured with light having a wavelength of 780 nm, and the value represented by a volume percentage (=(volume of methanol)/(volume of mixture)×100) of methanol when the transmittance reaches 50% is taken as the hydrophobicity. The initial volume ratio of methanol and water is adjusted as appropriate according to the hydrophobicity of the sample.

Amount of Polyvalent Metal Element in Toner Particle (ICP-AES)

The amount of the polyvalent metal element in the toner particle is quantitatively determined by an inductively-coupled plasma emission spectroscopic analyzer (ICP-AES (manufactured by Seiko Instruments Inc.)).

As pretreatment, acid decomposition is carried out using 8.00 mL of 60% nitric acid (manufactured by Kanto Chemical Co., Inc., for atomic absorption spectroscopy) with respect to 100.0 mg of toner particles.

At the time of acid decomposition, the treatment is carried out for 1 h in a sealed container at an internal temperature of 220° C. by a microwave high-power sample pretreatment apparatus ETHOS 1600 (manufactured by Milestone General Co., Ltd.) to prepare a sample of solution including a polyvalent metal element.

Thereafter, ultrapure water is added so that the total amount becomes 50.00 g to obtain a measurement sample. A calibration curve is prepared for each polyvalent metal element, and the amount of metal contained in each sample is quantitatively determined. Ultrapure water is added to 8.00 mL of nitric acid to make 50.00 g as a whole, the solution obtained is measured as a blank, and the amount of metal in the blank is subtracted.

Acid Value of Binder Resin in Toner Particle

The acid value is the number of milligrams of potassium hydroxide required to neutralize the acid contained in 1 g of the sample. The acid value is measured according to JIS K 0070-1992. Specifically, the acid value is measured according to the following procedure.

Titration is carried out using 0.1 mol/L potassium hydroxide ethyl alcohol solution (manufactured by Kishida Chemical Co., Ltd.). The factor of the potassium hydroxide ethyl alcohol solution can be obtained using a potentiometric titration apparatus (potentiometric titration apparatus AT-510 manufactured by Kyoto Electronics Industry Co., Ltd.). A total of 100 mL of 0.100 mol/L hydrochloric acid is taken in a 250 mL tall beaker and titrated with the potassium hydroxide ethyl alcohol solution, and the acid value is determined from the amount of the potassium hydroxide ethyl alcohol solution required for neutralization. The 0.100 mol/L hydrochloric acid is prepared according to JIS K 8001-1998.

Measurement conditions for acid value measurement are shown below.

Titration apparatus: potentiometric titration apparatus AT-510 (manufactured by Kyoto Electronics Industry Co., Ltd.)

Electrode: composite glass electrode of double junction type (manufactured by Kyoto Electronics Industry Co., Ltd.)

Control software for titrator: AT-WIN

Titration analysis software: Tview

Titration parameters and control parameters during titration are as follows.

Titration parameters

Titration mode: blank titration

Titration scheme: full amount titration

Maximum titration amount: 20 mL

Wait time before titration: 30 sec

Titration direction: automatic

Control Parameters

End point determination potential: 30 dE

End point determination potential value: 50 dE/dmL

End point detection determination: not set

Control speed mode: standard

Gain: 1

Data collection potential: 4 mV

Data collection titration amount: 0.1 mL

Main Rest:

A total of 0.100 g of the measurement sample is accurately weighed in a 250 mL tall beaker, 150 mL of a mixed solution of toluene/ethanol (3:1) is added, and dissolution is carried out over 1 h. Titration is carried out using the potentiometric titration apparatus and the potassium hydroxide ethyl alcohol solution.

Blank Test:

Titration is performed in the same manner as described hereinabove except that no sample is used (that is, only a mixed solution of toluene/ethanol (3:1) is used).

The obtained result is substituted into the following formula to calculate the acid value.

$$A=[(C-B)\times f\times 5.611]/S$$

(in the formula, A: acid value (mg KOH/g), B: addition amount (mL) of the potassium hydroxide ethyl alcohol solution in the blank test, C: addition amount (mL) of the potassium hydroxide ethyl alcohol solution in the main test, f: factor of potassium hydroxide solution, S: mass of the sample (g)).

Hereinafter, the present invention will be described in greater detail based on examples. Units in the formulations below are on a mass basis unless otherwise specified.

In order to clearly show the effects of the features of the present invention, the evaluation of developing performance and fixing performance in the examples and comparative examples of the present invention was carried out by setting the weight average particle diameter of the toner particles to 6.0 μm and setting the addition amount of silica fine particles to 1.0 part in toners 1 to 36 and toners 40 to 46 and 1.5 part for toners 37 to 39, while using the silica fine particle of the same kind. The effects of the present invention are thus explained in detail, but the present invention is not limited to these examples.

The strontium titanate fine particles were prepared in the following manner. Physical properties of the strontium titanate fine particles T1 to T8 are shown in Table 1.

Production Example 1 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.039 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T1.

Production Example 2 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.039 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 15 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T2.

Production Example 3 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.54 mol of strontium chloride aqueous solution was added to the peptized metatitanic acid slurry so that the molar ratio of Sr/Ti became 1.35, and the $TiO_2$ concentration was adjusted to 1.039 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T3.

Production Example 4 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.083 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T4.

Production Example 5 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 0.988 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T5.

Production Example 6 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.039 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T6.

Production Example 7 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 0.941 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T7.

Production Example 8 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 0.897 mol/L. Next, after warming to 90° C. under stirring and mixing, 440 mL of a 10 mol/L sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by mass based on the solid fraction was added, and stirring and holding were continued for 10 h. A 5 mol/L sodium hydroxide solution was added to adjust the pH to 6.5 and stirring was continued for 1 h, followed by filtration and washing, and the obtained cake was dried in air at 120° C. for 8 h to obtain strontium titanate fine particles T8.

Production Example 1 of Titanium Oxide Particles for Comparative Example

In a stainless steel container, 100 parts of rutile type titanium oxide having a weight average particle diameter of 35 nm was dispersed in ion exchanged water to prepare a slurry (including 6% by mass of titanium oxide) adjusted to pH 7. Thereafter, n-octyltriethoxysilane in an amount of 4.0% by mass based on the solid fraction was added to the slurry, and stirring was continued for 10 h. A 5 mol/L sodium hydroxide solution was added to adjust the pH to 6.5 and stirring was continued for 1 h, followed by filtration and washing. The obtained cake was dried in air at 120° C. for 8 h to obtain rutile type titanium oxide particles T9. The hydrophobicity of T9 was 76%.

Production Example 2 of Titanium Oxide Particles for Comparative Example

In a stainless steel container, 100 parts of anatase type titanium oxide having a weight average particle diameter of 35 nm was dispersed in ion exchanged water to prepare a slurry (including 6% by mass of titanium oxide) adjusted to pH 7. Thereafter, n-octyltriethoxysilane in an amount of 4.0% by mass based on the solid fraction was added to the slurry, and stirring was continued for 10 h. A 5 mol/L sodium hydroxide solution was added to adjust the pH to 6.5 and stirring was continued for 1 h, followed by filtration and washing. The obtained cake was dried in air at 120° C. for 8 h to obtain anatase type titanium oxide particles T10. The hydrophobicity of T10 was 78%.

TABLE 1

| Metal titanate fine particles | Number average particle diameter of primary particles (nm) | X-ray diffraction: Presence or absence of peak at 39.700° ± 0.150° | X-ray diffraction: Presence or absence of peak at 46.200° ± 0.150° | Sb/Sa | Sr/Ti molar ratio | Hydrophobicity (%) |
|---|---|---|---|---|---|---|
| Strontium titanate T1 | 35 | Presence | Presence | 2.03 | 0.79 | 75 |
| Strontium titanate T2 | 32 | Presence | Presence | 1.82 | 0.73 | 75 |
| Strontium titanate T3 | 42 | Presence | Presence | 2.22 | 0.86 | 76 |
| Strontium titanate T4 | 15 | Presence | Presence | 1.98 | 0.75 | 73 |
| Strontium titanate T5 | 58 | Presence | Presence | 2.06 | 0.81 | 77 |
| Strontium titanate T6 | 38 | Presence | Presence | 2.33 | 0.78 | 75 |
| Strontium titanate T7 | 78 | Presence | Presence | 2.21 | 0.79 | 74 |
| Strontium titanate T8 | 101 | Presence | Presence | 2.18 | 0.78 | 75 |

Preparation of Silica Particles

Untreated dry silica having a number average primary particle diameter of 18 nm was placed in a reactor equipped with a stirrer and then heated to 200° C. in a fluidized state created by stirring.

The inside of the reactor was purged with nitrogen gas to seal the reactor, 25% by mass of dimethylsilicone oil (viscosity=100 $mm^2$/sec) was sprayed with respect to 100% by mass of dry silica and stirring was continued for 30 min. Thereafter, the temperature was raised to 300° C. under stirring, and after further stirring for 2 h, the product was taken out and pulverized to obtain silica fine particles 1. The hydrophobicity of the silica fine particles 1 was 94%.

Preparation of Binder Resin Particle Dispersion 1

A total of 78.0 parts of styrene, 20.7 parts of butyl acrylate, 1.3 parts of acrylic acid as a monomer providing a carboxyl group, and 3.2 parts of n-lauryl mercaptan were mixed and dissolved. An aqueous solution prepared by dissolving 1.5 parts of NEOGEN RK (manufactured by Dai-ichi Kogyo Seiyaku Co., Ltd.) in 150 parts of ion exchanged water was added to this solution, followed by dispersing.

An aqueous solution of 0.3 part of potassium persulfate in 10 parts of ion exchanged water was then added while stirring slowly for further 10 min. After nitrogen substitution, emulsion polymerization was carried out at 70° C. for 6 h. After completion of the polymerization, the reaction liquid was cooled to room temperature, and ion exchanged water was added to obtain a resin particle dispersion 1 having a solid fraction concentration of 12.5% by mass and a volume-based median diameter of 0.2 μm.

In order to measure the acid value, some of the obtained resin particles were washed with pure water to remove the surfactant and dried under reduced pressure. As a result of measuring the acid value of the resin, it was confirmed to be 9.5 mg KOH/g.

Preparation of Binder Resin Particle Dispersion 2

A binder resin particle dispersion 2 was obtained in the same manner as in the preparation of binder resin particle dispersion solution 1, except that the amount of butyl acrylate and acrylic acid in the preparation of binder resin particle dispersion 1 was changed to 21.6 parts and 0.4 parts, respectively. It was confirmed that the volume-based median diameter of the resulting resin particle dispersion 2 was 0.2 μm and the acid value of the resin was 3.0 mg KOH/g.

Preparation of Binder Resin Particle Dispersion 3

A binder resin particle dispersion 3 was obtained in the same manner as in the preparation of binder resin particle dispersion 1, except that the amount of butyl acrylate and acrylic acid in the preparation of binder resin particle dispersion 1 was changed to 17.5 parts and 4.5 parts, respectively. It was confirmed that the volume-based median diameter of the resulting resin particle dispersion 3 was 0.2 μm and the acid value of the resin was 38.0 mg KOH/g.

Preparation of Release Agent Dispersion

A total of 100 parts of a release agent (behenyl behenate, melting point: 72.1° C.) and 15 parts of NEOGEN RK were mixed with 385 parts of ion exchanged water and dispersed for about 1 h using a wet jet mill JN 100 (manufactured by Junko Co., Ltd.) to obtain a release agent dispersion. The concentration of the release agent dispersion was 20% by mass.

Preparation of Colorant Dispersion

A total of 100 parts of carbon black "NIPEX 35 (manufactured by Orion Engineered Carbons)" as a colorant and 15 parts of NEOGEN RK were mixed with 885 parts of ion exchanged water and dispersed using a wet jet mill JN 100 for about 1 h to obtain a colorant dispersion.

Production Example of Toner Particles 1

A total of 265 parts of the resin particle dispersion 1, 10 parts of the wax dispersion and 10 parts of the colorant dispersion were dispersed using a homogenizer (ULTRA TURRAX T50, manufactured by IKA Works, Inc.). The temperature inside the vessel was adjusted to 30° C. under stirring, and 1 mol/L sodium hydroxide aqueous solution was added to adjust the pH to 8.0.

As a flocculant, an aqueous solution prepared by dissolving 0.25 parts of aluminum chloride in 10 parts of ion exchanged water was added over 10 min under stirring at 30° C. After allowing to stand for 3 min, the temperature was started to raise, and the temperature was raised to 50° C. to generate associated particles. In that state, the particle diameter of associated particles was measured with "Coulter Counter Multisizer 3" (registered trademark, manufactured by Beckman Coulter, Inc.). When the weight average particle diameter reached 6.0 μm, 0.9 parts of sodium chloride and 5.0 parts of NEOGEN RK were added to stop the particle growth.

A 1 mol/L sodium hydroxide aqueous solution was added to adjust the pH to 9.0, then the temperature was raised to 95° C., and the aggregated particles were spheroidized. When the average circularity reached 0.980, the temperature was started to be lowered, and cooling was performed to room temperature to obtain a toner particle dispersion 1.

Hydrochloric acid was added to the resultant toner particle dispersion 1 to adjust the pH to 1.5 or less, and after stirring for 1 h, solid-liquid separation was performed by a pressure filter to obtain a toner cake. This was re-slurried with ion exchanged water to prepare a dispersion again, followed by solid-liquid separation with the aforementioned filter. The re-slurrying and solid-liquid separation were repeated until the electric conductivity of the filtrate became 5.0 μS/cm or less, and finally the solid-liquid separation was performed to obtain a toner cake. The obtained toner cake was dried and further classified using a classifier so as to have a weight average particle diameter of 6.0 μm, thereby obtaining toner particles 1.

Production Example of Toner Particles 2

Toner particles 2 were produced in the same manner as the toner particles 1 except that the number of parts of aluminum chloride added as a flocculant was changed to 0.20 parts.

Production Example of Toner Particles 3

Toner particles 3 were produced in the same manner as the toner particles 1 except that the number of parts of aluminum chloride added as a flocculant was changed to 0.30 parts.

Production Example of Toner Particles 4

Toner particles 4 were produced in the same manner as the toner particles 1 except that the number of parts of aluminum chloride added as a flocculant was changed to 0.15 parts.

Production Example of Toner Particles 5

Toner particles 5 were produced in the same manner as the toner particles 1 except that the number of parts of aluminum chloride added as a flocculant was changed to 0.35 parts.

Production Example of Toner Particles 6

Toner particles 6 were produced in the same manner as the toner particles 1 except that the number of parts of aluminum chloride added as a flocculant was changed to 0.08 parts.

Production Example of Toner Particles 7

Toner particles 7 were produced in the same manner as the toner particles 1 except that the flocculant was changed from aluminum chloride to magnesium sulfate and the number of added parts of the flocculant was changed to 0.90 parts.

Production Example of Toner Particles 8

Toner particles 8 were produced in the same manner as the toner particles 7 except that the number of parts of magnesium sulfate added as a flocculant was changed to 1.15 parts.

Production Example of Toner Particles 9

Toner particles 9 were produced in the same manner as the toner particles 7 except that the number of parts of magnesium sulfate added as a flocculant was changed to 1.40 parts.

Production Example of Toner Particles 10

Toner particles 10 were produced in the same manner as the toner particles 7 except that the number of parts of magnesium sulfate added as a flocculant was changed to 1.90 parts.

Production Example of Toner Particles 11

Toner particles 11 were produced in the same manner as the toner particles 7 except that the number of parts of magnesium sulfate added as a flocculant was changed to 0.60 parts.

Production Example of Toner Particles 12

Toner particles 12 were produced in the same manner as the toner particles 1 except that the flocculant was changed from aluminum chloride to calcium chloride and the number of added parts of the flocculant was changed to 1.00 parts.

Production Example of Toner Particles 13

Toner particles 13 were produced in the same manner as the toner particles 1 except that the flocculant was changed from aluminum chloride to iron (III) chloride and the number of added parts of the flocculant was changed to 0.30 parts.

Production Example of Toner Particles 14

Toner particles 14 were produced in the same manner as the toner particles 13 except that the number of parts of iron (III) chloride added as a flocculant was changed to 0.35 parts.

Production Example of Toner Particles 15

Toner particles 15 were produced in the same manner as the toner particles 13 except that the number of parts of iron (III) chloride added as a flocculant was changed to 0.25 parts.

Production Example of Toner Particles 16

Toner particles 16 were produced in the same manner as the toner particles 13 except that the number of parts of iron (III) chloride added as a flocculant was changed to 0.50 parts.

Production Example of Toner Particles 17

Toner particles 17 were produced in the same manner as the toner particles 13 except that the number of parts of iron (III) chloride added as a flocculant was changed to 0.20 parts.

Production Example of Toner Particles 18

Toner particles 18 were produced in the same manner as the toner particles 1 except that the number of parts of aluminum chloride added as a flocculant was changed to 0.05 parts.

Production Example of Toner Particles 19

Toner particles 19 were produced in the same manner as the toner particles 7 except that the number of parts of magnesium sulfate added as a flocculant was changed to 2.50 parts.

Production Example of Toner Particles 20

Toner particles 20 were produced in the same manner as the toner particles 1 except that the flocculant was changed from aluminum chloride to copper (II) chloride and the number of added parts of the flocculant was changed to 0.80 parts.

Production Example of Toner Particles 21

Toner particles 21 were produced in the same manner as the toner particles 1 except that the flocculant was changed from aluminum chloride to tin (II) chloride and the number of added parts of the flocculant was changed to 0.80 parts.

Production Example of Toner Particles 22

Toner particles 22 were produced in the same manner as the toner particles 1 except that the resin particle dispersion 2 was used in place of the resin particle dispersion 1.

Production Example of Toner Particles 23

Toner particles 23 were produced in the same manner as the toner particles 1 except that the resin particle dispersion 3 was used in place of the resin particle dispersion 1.

Production Example of Toner 1

The strontium titanate fine particles T1 (0.8 parts) and the silica fine particles 1 (1.0 part) were externally added to the toner particles 1 (100 parts) and mixed with FM 10C (manufactured by Nippon Coke & Engineering Co., Ltd.). The external addition conditions were as follows: the lower blade was set to an A0 blade, the distance between the lower blade and the wall of the deflector was set to 20 mm, the charged amount of the toner particles was 2.0 kg, the rotation speed was 50.0 $s^{-1}$, the external addition time was 12 min, and the cooling water temperature and flow rate were 22° C. and 11 L/min. A toner 1 was thereafter obtained by sieving with a mesh having an opening of 200 μm. Table 2 shows the production conditions of toner 1 and physical properties of the toner.

Production Examples of Toners 2 to 34 and Comparative Toners 1 to 12

Toners 2 to 34 and comparative toners 1 to 12 were produced in the same manner as in the production example of toner 1 except that the toner particles used, the amounts added of strontium titanate fine particles and silica fine particles, and the external addition time were changed as shown in Table 2. The external addition conditions and physical properties are shown in Table 2.

Example 1

The toner 1 was evaluated in the following manner. The evaluation results are shown in Table 3.

For the evaluation, modified LBP712Ci (manufactured by Canon Inc.) was used as an evaluation machine. The process speed of the main body was modified to 270 mm/sec. Then, necessary adjustments were made so as to enable image formation under this condition. Further, a toner was removed from the black cartridge, and 160 g of the toner 1 was loaded instead.

Evaluation of Developing Performance

Evaluation of Durability Fogging Under Low-Temperature and Low-Humidity Environment Fogging after continuous use under a low-temperature and low-humidity environment (15° C./10% RH) was evaluated. Paper for XEROX 4200 (manufactured by XEROX Co., 75 g/$m^2$) was used as evaluation paper.

Intermittent-continuous use was implemented with respect to 15,000 prints by outputting two E character images at a print percentage of 1% every 4 sec under a low-temperature and low-humidity environment.

After that, a solid white image was outputted, the worst value of the reflection density on the white background portion was denoted by Ds, the reflection average density of the transfer material before the image formation was denoted by Dr, and Dr−Ds was taken as the fogging value.

The reflection density on the white background portion was measured using a reflection densitometer (Reflectometer Model TC-6DS manufactured by Tokyo Denshoku Co., Ltd.), and an amber light filter was used.

The smaller the value, the better the evaluation. Evaluation criteria are presented below.

Evaluation Criteria

A: less than 0.5%

B: from 0.5% to less than 1.5%

C: from 1.5% to less than 2.5%

D: from 2.5% to less than 4.0%

E: 4.0% or more

Evaluation of Stripe Image

The stripe image is an image defect in the form of a vertical stripe of about 0.5 mm generated due to member contamination by external additives and toner deterioration. This defect is easy to observe when outputting a full-surface halftone image.

To evaluate the stripe image, a continuous use test of 15,000 prints was performed under the same environment as the fogging evaluation, the full-surface halftone image was outputted and the presence or absence of stripes was observed.

Evaluation Criteria

A: no stripes or toner lumps were generated

B: no spot-like stripes, but there are 1 to 3 small toner lumps

C: there are a few spot-like stripes in the end portion, or there are small toner lumps at 4 or 5 places D: there are spot-like stripes on the entire surface, or there are small toner lumps or clear toner lumps at 5 or more places Evaluation of Fogging when Allowed to Stand after Continuous Use Under High-Temperature and High-Humidity Environment The fogging was evaluated under a high-temperature and high-humidity environment (30° C./80% RH). Paper for XEROX 4200 (manufactured by XEROX Co., 75 g/m$^2$) was used as evaluation paper.

Intermittent-continuous use was implemented with respect to 15,000 prints by outputting two E character images at a print percentage of 1.5% every 4 sec under a high-temperature and high-humidity environment. After that, the power supply of the main body was stopped and the system was allowed to stand for 72 h under a high-temperature and high-humidity environment. After that, the main body was restarted and fogging evaluation was carried out in the same manner as above.

A solid white image was outputted, the worst value of the reflection density on the white background portion was denoted by Ds, the reflection average density of the transfer material before the image formation was denoted by Dr, and Dr−Ds was taken as the fogging value.

The reflection density on the white background portion was measured using a reflection densitometer (Reflectometer Model TC-6DS manufactured by Tokyo Denshoku Co., Ltd.), and an amber light filter was used.

The smaller the value, the better the evaluation. Evaluation criteria are presented below.

Evaluation Criteria

A: less than 0.5%

B: from 0.5% to less than 1.5%

C: from 1.5% to less than 2.5%

D: from 2.5% to less than 4.0%

E: 4.0% or more

Evaluation of Fixing Performance

Low-temperature Fixability

A color laser printer LBP712Ci (manufactured by Canon Inc.) from which the fixing unit was removed was prepared, the toner was taken out from the black cartridge, and the toner to be evaluated was filled instead. As a recording medium, color laser copier paper (manufactured by Canon Inc., 80 g/m$^2$) was used. Next, the filled toner was used to form an unfixed image of 2.0 cm in length and 15.0 cm in width in a portion of 1.0 cm from the upper end with respect to the paper passing direction so as to obtain a toner laid-on level of 0.20 mg/cm$^2$. Next, the removed fixing unit was modified so that the fixing temperature and the process speed could be adjusted, and the fixing test of the unfixed image was carried out using the modified fixing unit.

First, under the normal-temperature and normal-humidity environment (23° C., 60% RH), the process speed was set to 270 mm/s, the fixing line pressure was set to 27.4 kgf, the initial temperature was set to 110° C., the set temperature was gradually raised by 5° C., and fixing of the unfixed image was performed at each temperature.

Evaluation criteria for low-temperature fixability are as follows. The low-temperature fixing start point is the lowest temperature at which the density decrease ratio of image density before and after rubbing becomes 10.0% or less when the surface of the image is rubbed five times at a speed of 0.2 m/sec with Silbon paper (DASPER K-3) under a load of 4.9 kPa (50 g/cm$^2$). When the fixing is not performed firmly, the decrease ratio of image density tends to increase.

The evaluation results are shown in Table 3.

Evaluation Criteria

A: low-temperature fixing start point is 120° C. or less

B: low-temperature fixing start point is 125° C. or 130° C.

C: low-temperature fixing start point is 135° C. or 140° C.

D: low-temperature fixing start point is 145° C. or more

TABLE 2

| | | Toner | Polyvalent metal element | | | Strontium titanate particles | | | | | External addition |
|---|---|---|---|---|---|---|---|---|---|---|---|
| Example No. | Toner No. | particle No. | Polyvalent metal element | Electric resistivity | Amount | No. | Parts | Fixing ratio (%) | Coverage ratio (%) | Silica (parts) | condition Time (min) |
| 1 | 1 | 1 | Aluminum | 2.7 | 0.240 | T 1 | 0.80 | 91 | 6.0 | 1.0 | 12.0 |
| 2 | 2 | 1 | Aluminum | 2.7 | 0.240 | T 2 | 0.50 | 90 | 6.0 | 1.0 | 12.0 |
| 3 | 3 | 1 | Aluminum | 2.7 | 0.240 | T 3 | 0.80 | 88 | 5.2 | 1.0 | 12.0 |
| 4 | 4 | 2 | Aluminum | 2.7 | 0.160 | T 1 | 0.80 | 98 | 6.0 | 1.0 | 14.0 |
| 5 | 5 | 3 | Aluminum | 2.7 | 0.320 | T 1 | 0.80 | 90 | 6.0 | 1.0 | 12.0 |
| 6 | 6 | 1 | Aluminum | 2.7 | 0.240 | T 1 | 0.80 | 88 | 5.8 | 1.0 | 12.0 |
| 7 | 7 | 1 | Aluminum | 2.7 | 0.240 | T 1 | 0.80 | 91 | 6.1 | 1.0 | 12.0 |
| 8 | 8 | 1 | Aluminum | 2.7 | 0.240 | T 1 | 0.80 | 70 | 5.6 | 1.0 | 9.0 |
| 9 | 9 | 4 | Aluminum | 2.7 | 0.100 | T 1 | 0.80 | 90 | 6.0 | 1.0 | 12.0 |
| 10 | 10 | 5 | Aluminum | 2.7 | 0.400 | T 1 | 0.80 | 90 | 6.0 | 1.0 | 12.0 |
| 11 | 11 | 6 | Aluminum | 2.7 | 0.080 | T 1 | 0.80 | 91 | 6.0 | 1.0 | 12.0 |
| 12 | 12 | 1 | Aluminum | 2.7 | 0.240 | T 1 | 0.80 | 60 | 5.5 | 1.0 | 8.0 |
| 13 | 13 | 1 | Aluminum | 2.7 | 0.240 | T 1 | 0.10 | 89 | 0.8 | 1.0 | 12.0 |
| 14 | 14 | 1 | Aluminum | 2.7 | 0.240 | T 1 | 2.00 | 90 | 15.0 | 1.0 | 12.0 |
| 15 | 15 | 7 | Magnesium | 4.5 | 6.500 | T 1 | 0.80 | 90 | 6.0 | 1.0 | 12.0 |
| 16 | 16 | 8 | Magnesium | 4.5 | 9.800 | T 1 | 0.80 | 90 | 6.0 | 1.0 | 12.0 |
| 17 | 17 | 9 | Magnesium | 4.5 | 14.000 | T 1 | 0.80 | 91 | 6.0 | 1.0 | 12.0 |
| 18 | 18 | 10 | Magnesium | 4.5 | 20.000 | T 1 | 0.80 | 90 | 6.0 | 1.0 | 12.0 |
| 19 | 19 | 11 | Magnesium | 4.5 | 1.950 | T 1 | 0.80 | 88 | 6.0 | 1.0 | 12.0 |
| 20 | 20 | 12 | Calcium | 3.5 | 4.000 | T 1 | 0.80 | 91 | 6.0 | 1.0 | 12.0 |
| 21 | 21 | 13 | Iron | 9.7 | 0.500 | T 1 | 0.80 | 89 | 6.0 | 1.0 | 12.0 |
| 22 | 22 | 14 | Iron | 9.7 | 0.750 | T 1 | 0.80 | 90 | 6.0 | 1.0 | 12.0 |
| 23 | 23 | 15 | Iron | 9.7 | 0.330 | T 1 | 0.80 | 90 | 6.0 | 1.0 | 12.0 |
| 24 | 24 | 16 | Iron | 9.7 | 1.250 | T 1 | 0.80 | 91 | 6.0 | 1.0 | 12.0 |
| 25 | 25 | 17 | Iron | 9.7 | 0.250 | T 1 | 0.80 | 90 | 6.0 | 1.0 | 12.0 |
| 26 | 26 | 1 | Aluminum | 2.7 | 0.240 | T 4 | 1.10 | 87 | 20.0 | 1.0 | 12.0 |
| 27 | 27 | 1 | Aluminum | 2.7 | 0.240 | T 5 | 0.07 | 90 | 0.5 | 1.0 | 12.0 |
| 28 | 28 | 1 | Aluminum | 2.7 | 0.240 | T 6 | 0.80 | 91 | 6.0 | 1.0 | 12.0 |
| 29 | 29 | 1 | Aluminum | 2.7 | 0.240 | T 7 | 1.50 | 89 | 5.0 | 1.0 | 12.0 |

TABLE 2-continued

| Example No. | Toner No. | Toner particle No. | Polyvalent metal element: Polyvalent metal element | Polyvalent metal element: Electric resistivity | Polyvalent metal element: Amount | Strontium titanate particles: No. | Strontium titanate particles: Parts | Strontium titanate particles: Fixing ratio (%) | Strontium titanate particles: Coverage ratio (%) | Silica (parts) | External addition condition Time (min) |
|---|---|---|---|---|---|---|---|---|---|---|---|
| 30 | 30 | 1 | Aluminum | 2.7 | 0.240 | T 1 | 0.80 | 50 | 5.2 | 1.0 | 6.0 |
| 31 | 31 | 22 | Aluminum | 2.7 | 0.240 | T 1 | 0.80 | 90 | 6.0 | 1.0 | 12.0 |
| 32 | 32 | 23 | Aluminum | 2.7 | 0.240 | T 1 | 0.80 | 90 | 6.0 | 1.0 | 12.0 |
| 33 | 33 | 1 | Aluminum | 2.7 | 0.240 | T 5 | 0.02 | 91 | 0.2 | 1.0 | 12.0 |
| 34 | 34 | 1 | Aluminum | 2.7 | 0.240 | T 4 | 2.20 | 89 | 25.0 | 1.0 | 12.0 |
| C.E. 1 | 35 | 1 | Aluminum | 2.7 | 0.240 | T 8 | 1.80 | 90 | 5.0 | 1.0 | 12.0 |
| C.E. 2 | 36 | 1 | Aluminum | 2.7 | 0.240 | Unadded | | | | 1.0 | 12.0 |
| C.E. 3 | 37 | 1 | Aluminum | 2.7 | 0.240 | T 9 | 0.10 | Unadded (titanium oxide) | | 1.0 | 12.0 |
| C.E. 4 | 38 | 1 | Aluminum | 2.7 | 0.240 | T 9 | 0.80 | Unadded (titanium oxide) | | 1.0 | 12.0 |
| C.E. 5 | 39 | 1 | Aluminum | 2.7 | 0.240 | T 9 | 2.00 | Unadded (titanium oxide) | | 1.0 | 12.0 |
| C.E. 6 | 40 | 1 | Aluminum | 2.7 | 0.240 | T 10 | 0.10 | Unadded (titanium oxide) | | 1.5 | 12.0 |
| C.E. 7 | 41 | 1 | Aluminum | 2.7 | 0.240 | T 10 | 0.80 | Unadded (titanium oxide) | | 1.5 | 12.0 |
| C.E. 8 | 42 | 1 | Aluminum | 2.7 | 0.240 | T 10 | 2.00 | Unadded (titanium oxide) | | 1.5 | 12.0 |
| C.E. 9 | 43 | 18 | Aluminum | 2.7 | 0.040 | T 1 | 0.80 | 88 | 6.0 | 1.0 | 12.0 |
| C.E. 10 | 44 | 19 | Magnesium | 4.5 | 26.000 | T 1 | 0.80 | 89 | 6.0 | 1.0 | 12.0 |
| C.E. 11 | 45 | 20 | Copper | 1.7 | 1.350 | T 1 | 0.80 | 90 | 6.0 | 1.0 | 12.0 |
| C.E. 12 | 46 | 21 | Tin | 11.5 | 1.400 | T 1 | 0.80 | 91 | 6.0 | 1.0 | 12.0 |

In the table, "Electric resistivity" is the electric resistivity ($\times 10^{-8}$ Ω·m) of the polyvalent metal element at 20° C. "Amount" is the amount (μmol/g) of the polyvalent metal element in the toner particle. "C.E." denotes Comparative Example.

TABLE 3

| Example No. | Fixability evaluation | LL developing performance (durability fogging): Fogging concentration (%) | LL developing performance (durability fogging): Rank | LL developing performance (development stripes) | HH developing performance (durability fogging): Fogging concentration (%) | HH developing performance (durability fogging): Rank |
|---|---|---|---|---|---|---|
| 1 | A | 0.3 | A | A | 0.3 | A |
| 2 | A | 0.3 | A | A | 0.3 | A |
| 3 | A | 0.4 | A | B | 0.4 | A |
| 4 | A | 0.4 | A | B | 0.4 | A |
| 5 | A | 0.3 | A | A | 0.3 | A |
| 6 | A | 0.4 | A | A | 0.4 | A |
| 7 | A | 0.4 | A | A | 0.3 | A |
| 8 | A | 1.0 | B | B | 0.9 | B |
| 9 | A | 0.3 | A | A | 0.4 | A |
| 10 | C | 0.4 | A | A | 1.8 | C |
| 11 | A | 1.2 | B | A | 0.4 | A |
| 12 | A | 2.0 | C | C | 1.3 | B |
| 13 | A | 1.1 | B | B | 0.4 | A |
| 14 | A | 0.4 | A | A | 1.2 | B |
| 15 | A | 0.3 | A | A | 0.3 | A |
| 16 | A | 0.4 | A | A | 0.4 | A |
| 17 | B | 0.4 | A | A | 1.1 | B |
| 18 | C | 0.3 | A | A | 2.2 | C |
| 19 | A | 2.0 | C | C | 0.4 | A |
| 20 | A | 0.4 | A | A | 0.3 | A |
| 21 | A | 0.3 | A | A | 0.3 | A |
| 22 | A | 0.4 | A | A | 0.3 | A |
| 23 | A | 1.0 | B | B | 0.4 | A |
| 24 | C | 0.3 | A | A | 1.8 | C |
| 25 | A | 2.2 | C | B | 0.4 | A |
| 26 | C | 0.4 | A | A | 1.4 | B |
| 27 | A | 1.1 | B | B | 0.3 | A |
| 28 | A | 0.9 | B | B | 0.4 | A |
| 29 | A | 1.9 | C | C | 0.4 | A |
| 30 | A | 2.8 | D | C | 2.0 | C |
| 31 | A | 2.9 | D | C | 1.0 | B |
| 32 | C | 1.0 | B | B | 1.8 | C |
| 33 | A | 3.0 | D | C | 2.0 | C |
| 34 | C | 0.4 | A | A | 2.8 | D |
| C.E. 1 | A | 4.5 | E | D | 2.1 | C |
| C.E. 2 | A | 5.0 | E | D | 3.8 | D |
| C.E. 3 | A | 4.8 | E | D | 2.3 | C |
| C.E. 4 | A | 4.5 | E | D | 3.0 | D |

TABLE 3-continued

| Example No. | Fixability evaluation | LL developing performance (durability fogging) Fogging concentration (%) | Rank | LL developing performance (development stripes) | HH developing performance (durability fogging) Fogging concentration (%) | Rank |
|---|---|---|---|---|---|---|
| C.E. 5 | A | 3.8 | D | D | 4.5 | E |
| C.E. 6 | D | 1.2 | B | B | 2.0 | C |
| C.E. 7 | D | 1.3 | B | B | 2.3 | C |
| C.E. 8 | D | 1.1 | B | B | 4.4 | E |
| C.E. 9 | A | 4.8 | E | D | 1.2 | B |
| C.E. 10 | D | 1.0 | B | C | 4.8 | E |
| C.E. 11 | A | 1.4 | B | B | 5.2 | E |
| C.E. 12 | A | 5.3 | E | D | 1.4 | B |

In the table, "C.E." denotes Comparative Example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-86034, filed Apr. 27, 2018, and Japanese Patent Application No. 2019-62888, filed Mar. 28, 2019, which are hereby incorporated by reference herein in their entirety.

What is claimed is:

1. A toner comprising:

a toner particle containing a binder resin and a colorant; and metal titanate fine particles having a perovskite crystal structure on a surface of the toner particle, wherein the toner particle includes a polyvalent metal element having an electric resistivity at 20° C. of $2.5\times10^{-8}$ to $10.0\times10^{-8}$ Ω·m, the amount of the polyvalent metal element in the toner particle is 0.080 to 20.000 μmol/g, the number average particle diameter of primary particles of the metal titanate fine particles is 10 to 80 nm, a fixing ratio of the metal titanate fine particles to the toner particle is 60 to 100% as determined by comparing X-ray fluorescence analyses of a tablet of 1 g unwashed toner with a tablet of 1 g washed toner, the washed toner being prepared by adding 1 g of unwashed toner to a centrifuge tube containing a dispersion of (i) 31 g of a solution of 100 ml ion exchanged water and 160 g sucrose and (ii) 6 ml of a 10% by mass aqueous solution at pH 7 consisting of a nonionic surfactant, an anionic surfactant and an organic builder, shaking the centrifuge tube at 5.8 $s^{-1}$ for 20 min, transferring the solution from the shaken centrifuge tube to a 50 ml glass tube and centrifuging the glass tube at 58.3 $s^{-1}$ for 30 min to separate the toner, collecting separated washed toner from the glass tube, and vacuum filtering and drying the washed toner, and a coverage ratio of the surface of the toner particle with the metal titanate fine particles measured with an X-ray photoelectron spectrometer is 0.5 to 20.0% by area.

2. The toner according to claim 1, wherein the polyvalent metal element is at least one member selected from the group consisting of aluminum, iron, magnesium and calcium.

3. The toner according to claim 1, wherein the binder resin includes a carboxyl group, and the polyvalent metal element is at least one member selected from the group consisting of aluminum, iron, magnesium and calcium such that when the polyvalent metal element includes aluminum, the amount of aluminum in the toner particle is 0.080 to 0.400 μmol/g, when the polyvalent metal element includes iron, the amount of iron in the toner particle is 0.250 to 1.250 μmol/g, when the polyvalent metal element includes magnesium, the amount of magnesium in the toner particle is 2.000 to 20.000 μmol/g, and when the polyvalent metal element includes calcium, the amount of calcium in the toner particle is 2.000 to 20.000 μmol/g.

4. The toner according to claim 1, wherein the metal titanate fine particles include strontium titanate fine particles.

5. The toner according to claim 4, wherein in an X-ray diffraction spectrum of CuKα obtained in the range of 2θ of 10° to 90°, with θ being a Bragg angle of the strontium titanate fine particles, peaks derived from the strontium titanate fine particles are at 39.700°±0.150° and 46.200°±0.150°, and Sb/Sa is 1.80 to 2.30 when an area of the peak at 39.700°±0.150° is denoted by Sa and an area of the peak at 46.200°±0.150° is denoted by Sb.

6. The toner according to claim 1, wherein the number average particle diameter of primary particles of the metal titanate fine particles is 10 to 60 nm.

7. The toner according to claim 1, wherein the binder resin has an acid value of 1.0 to 40.0 mg KOH/g.

8. The toner according to claim 1, wherein the toner particle is an emulsion aggregation toner particle.

* * * * *